US005277116A

United States Patent [19]

Axinger et al.

[11] Patent Number: 5,277,116

[45] Date of Patent: Jan. 11, 1994

[54] SUB-COMBAT UNITS

[75] Inventors: Jan Axinger, Storfors; Peter Engman, Karlskoga, both of Sweden

[73] Assignee: Bofors AB, Karlskoga, Sweden

[21] Appl. No.: 946,617

[22] Filed: Sep. 18, 1992

[30] Foreign Application Priority Data

Sep. 18, 1991 [SE] Sweden ..... 9102702

[51] Int. Cl.[5] ..... F42B 10/50; F42B 12/58

[52] U.S. Cl. ..... 102/388; 102/393; 102/489; 244/3.27

[58] Field of Search ..... 102/388, 386, 387, 384, 102/393, 489; 244/3.27, 3.28, 3.29

[56] References Cited

U.S. PATENT DOCUMENTS

| | | | |
|---|---|---|---|
| 3,697,019 | 10/1972 | Watson | 244/3.29 |
| 3,712,217 | 1/1973 | Little et al. | 102/388 |
| 3,853,288 | 12/1972 | Bode | 244/3.29 |
| 4,691,636 | 9/1987 | Witt et al. | 102/387 |
| 4,817,891 | 4/1989 | Gaywood | 244/3.29 |
| 4,979,876 | 12/1990 | Chapman | 244/3.29 |
| 4,984,967 | 1/1991 | Cruzen | 244/3.28 |
| 5,063,849 | 11/1991 | Axinger | 102/388 |
| 5,082,203 | 1/1992 | Baubry | 244/3.28 |
| 5,088,414 | 2/1992 | Vesa | 102/388 |

FOREIGN PATENT DOCUMENTS 8903474-8 6/1991 Sweden .

*Primary Examiner*—David H. Brown

*Attorney, Agent, or Firm*—Pollock, Vande Sande & Priddy

[57] ABSTRACT

A sub-combat unit is arranged to be separated from a flying body over a target area, and includes a warhead, a target detector and two diametrically disposed carrier surfaces, each connected to a carrier arm and pivotally disposed about its own shaft located in a plane which is normal to the line of symmetry of the warhead and pivotable from a collapsed position in which the carrier arms and carrier surfaces connect to the circumferencial surface of the sub-combat unit, and to a position opened at 90° at which both of the carrier surfaces form a retarding area for the fall velocity of the sub-combat unit and to impart to the sub-combat unit a rotation for scanning the target area in a helical pattern during the fall of the sub-combat unit towards the target area. Compressible damping devices are provided on the casing of the sub-combat unit which are compressed by the carrier arms during the flip-out movement of the carrier surfaces, and return stops for retaining the carrier arms and the carrier surfaces in a final flip-out position.

7 Claims, 2 Drawing Sheets

SUB-COMBAT UNITS

TECHNICAL FIELD

The present invention relates to a sub-combat unit which is arranged to be separated from a flying body, for example a carrier shell or the like, over a target area, the sub-combat unit including a warhead, a target detector and two diametrically disposed carrier surfaces which, via carrier arms, are pivotally disposed each on its own shaft located in a plane which is normal to the line of symmetry of the warhead, from a collapsed position in which the carrier surfaces connect to the circumferential surface of the sub-combat unit, and to a position opened at 90° at which both of the carrier surfaces form a retarding area for retarding the velocity of the sub-combat unit and imparting to the sub-combat unit a rotation for scanning the target area in a helical pattern during the fall of the sub-combat unit towards the target area. One such sub-combat unit has been previously described in Swedish patent specification 89.03474-8.

BACKGROUND ART

Both of the carrier surfaces are relatively thin and may, for example, be made of titanium. This material is elastically bendable so that the carrier surfaces, in their inwardly collapsed state, follow the circumferential surface of the sub-combat unit, but in their opened-out or flip-out position are bent out to a position at which they assume a certain shape.

In their closed position, the carrier surfaces are locked to the circumferential surface of the sub-combat unit in a suitable manner, for example the thin carrier surface profile may engage in a groove or slot in the circumferential surface. The carrier surfaces are twisted from their inwardly closed position with the aid of their inherent energy, the rotational and aerodynamic forces, through 90° to their flipped-out position.

Swedish patent specification 89.03474-8 proposes that a damping device be introduced such that the carrier surfaces are stopped gently in the flipped-out position, and any possible pendulum motion is prevented.

SUMMARY OF THE INVENTION

One object of the present invention is to provide a wing flip-out mechanism which permits a high flip-out speed of the carrier surfaces and gentle braking to a final, flipped-out position. Furthermore, the mechanism must be of simple and compact construction and it may not take up any appreciable space.

According to the present invention, there are disposed on each carrier surface, in connection with the casing of the sub-combat unit, damping devices which are disposed to be compressed by the carrier arms on flip-out of the carrier surfaces, and further return stops against which the carrier arms are operative to spring back.

The damper devices are preferably placed in the casing of the sub-combat unit such that they, together with carrier arms and carrier surfaces, follow the casing surface of the sub-combat unit when the carrier surfaces are located in their inwardly closed position.

The damping devices will provide a gentle braking and restricted return movement to a final, well-defined flip-out position of the carrier surfaces.

BRIEF DESCRIPTION OF THE ACCOMPANYING DRAWINGS

The present invention will now be described in greater detail hereinbelow, with particular reference to the accompanying drawings which show one example of how the wing flip-out mechanism may be designed. In the accompanying drawings.

DESCRIPTION OF ONE EMBODIMENT

Figure 1:
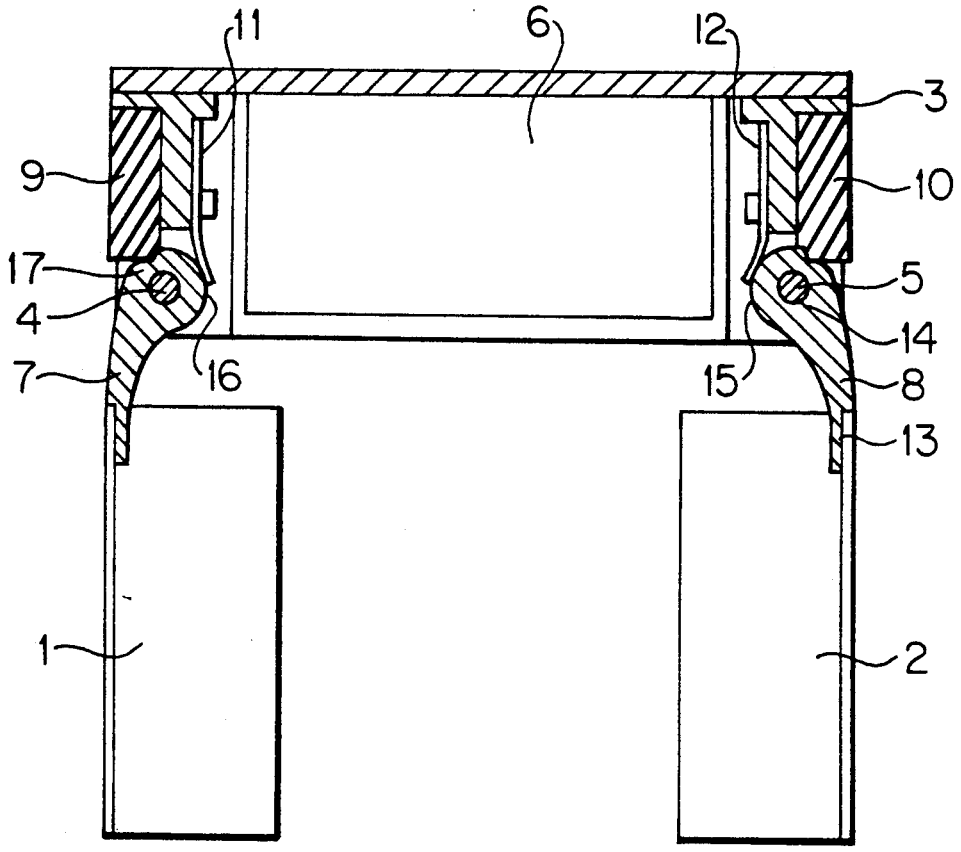
FIG. 1 shows the sub-combat unit of the present invention with the carrier surfaces in the closed position.
Figure 2:
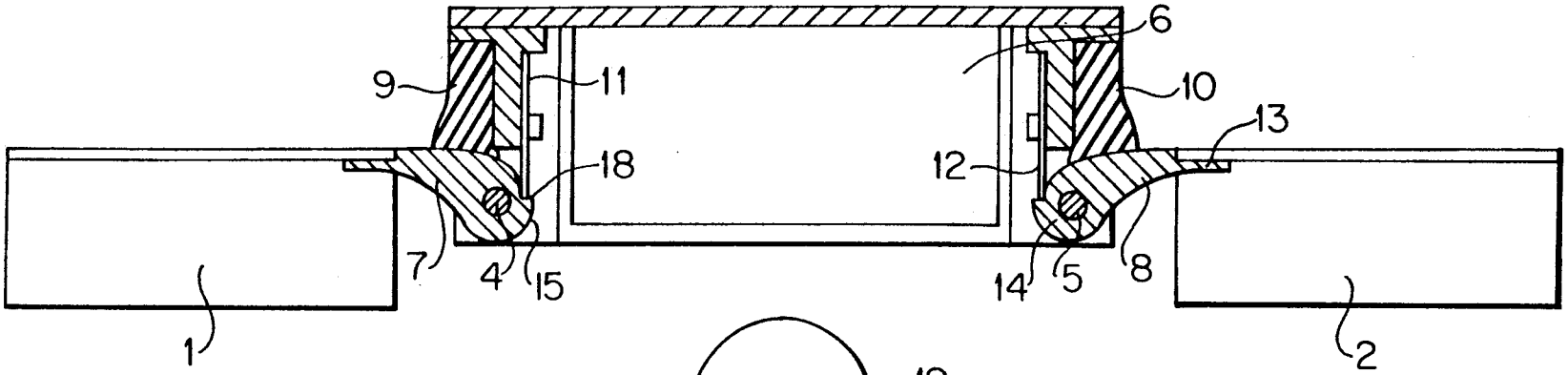
FIG. 2 shows the carrier surfaces in their flip-out position.
Figure 3:
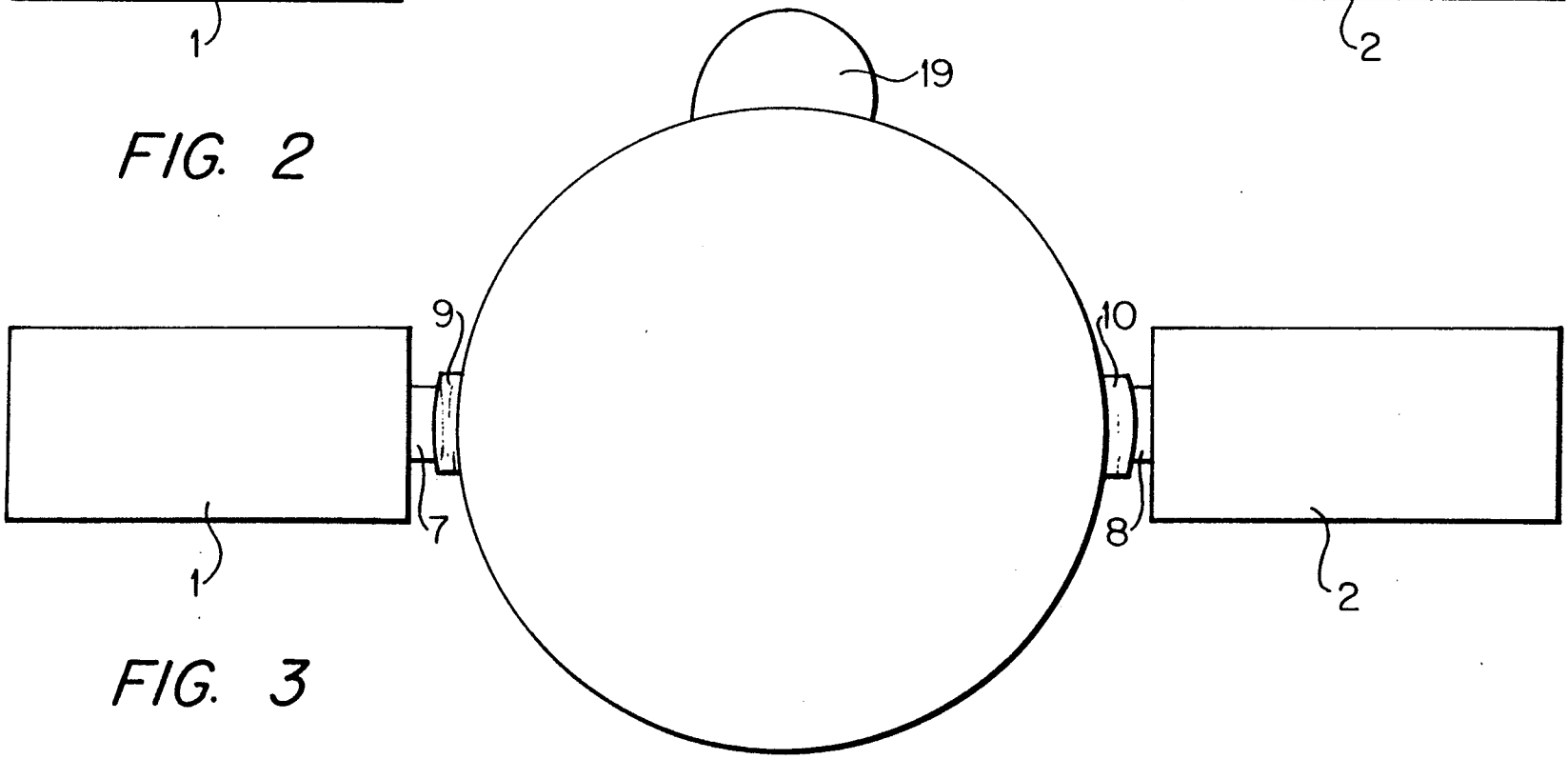
FIG. 3 shows a top view of the sub-combat unit.

The sub-combat unit is arranged to be separated from a vehicle or carrier shell. The carrier shell may, for example, be of 15.5 cm caliber and be discharged from a field artillery gun in a conventional manner in a ballistic trajectory towards a target area. The sub-combat unit includes a warhead 6 and a target detector 19. In order to impart to the sub-combat unit controlled scanning movement of the target area, that is a controlled rotation and fall velocity, two diametric carrier surfaces 1 and 2 are pivotally disposed from an inwardly closed position in which the carrier surfaces connect to the casing surface 3 of the sub-combat unit, to a flipped-out position in which the two carrier surfaces form a retarding area. Both of the carrier surfaces 1, 2 are pivotally disposed on flip-out shafts 4, 5 which are at right angles to the line of symmetry of the warhead. The warhead 6 may be of a known type and will not, therefore, be described in greater detail here.

As opposed to the sub-combat unit described in patent specification 89.03474-8 mentioned by way of introduction, the sub-combat unit according to the present invention includes a special wing flip-out mechanism which consists of the two carrier arms 7, 8, damping devices, 9, 10 and return stops 11, 12.

Since the wings flip out at high speed and rotation, the wings (the carrier surfaces) will move at a high flip-out speed. In order that the wings are not snapped, a gentle braking to a final position must take place. This is achieved as follows.

The one, narrower end 13 of the carrier arms is fixedly connected to each respective carrier surface 1, 2, while its other end 14 is pivotally journalled on each respective flip-out shaft 4, 5. The other end carries a substantially circular end surface 15 and abuts against both the damping device 9, 10 and the return stop 11, 12 even in its inwardly closed position. In the inwardly closed position, both damping devices and carrier arms connect to the casing surface of the sub-combat unit.

When the carrier arm is twisted out from its inwardly closed position, the damping device (which may consist of a rubber bushing) is compressed by the abutment surface of the carrier arm. The return stop is designed as a leaf spring whose free end 16 resiliently abuts against the end surface 15 of the carrier arm and slides along this during the pivoting movement.

When the carrier surfaces have reached their maximum flip-out and the damping devices have been fully compressed, the energy stored in the damping devices will strive to return the carrier surfaces. Consequently, the end surface of the carrier arm is provided with a recess 17 with a substantially radial surface 18 against which the free end 16 of the leaf spring will come into abutment so that a well-defined final flip-out position will be assumed by the carrier surfaces. The rubber damper has been selected such that, in the compressed state, it possesses sufficient latent energy to be able to return the carrier arm to the return stop.

The present invention should not be considered as restricted to that described above and shown on the drawings, many modifications being conceivable without departing from the spirit and scope of the appended claims.

What we claim and desire to secure by Letters Patent is:

1. A sub-combat unit arranged to be separated from a flying body over a target area, the sub-combat unit including:

a warhead, a target detector and two diametrically disposed carrier surfaces, each connected to a carrier arm and pivotally disposed about a shaft located in a plane which is normal to the line of symmetry of the warhead and pivotable from a collapsed position in which the carrier arms and carrier surfaces connect to a flip-out circumferencial surface of the sub-combat unit, and to a position opened at 90° at which both of the carrier surfaces form a retarding area for the fall velocity of the sub-combat unit and to impart to the sub-combat unit a rotation for scanning the target area in a helical pattern during the fall of the sub-combat unit towards the target area, said sub-combat unit also including compressible damping devices provided on the casing of the sub-combat unit which are compressed by the carrier arms during the flip-out movement of the carrier surfaces, and return stops for retaining the carrier arms and the carrier surfaces in a final flip-out position.

2. The sub-combat unit as claimed in claim 1, wherein each of the carrier arms at the end that is journalled on the shaft includes an abutment surface which, in the collapsed position of the carrier arm abuts against a damping device and, in the flip-out position, abuts against the return stop.

3. The sub-combat unit as claimed in claim 2, wherein the abutment surface includes a recess in a substantially circular end surface of the carrier arm and the recess has a substantially radial surface against which the return stop abuts when the carrier surfaces assume their final flip-out position.

4. The sub-combat unit as claimed in claim 3, wherein the return stop includes a lead spring whose one end is permanently secured in the casing of the sub-combat unit while its other, free end resiliently abuts against the circular end surface of the carrier arm and, during flip-out of the carrier surfaces, follows the end surface and engages in said recess to restrict the return movement of the carrier arm.

5. In a sub-combat unit separable from a flying body over a target area, the unit including a warhead, a target detector and two diametrically disposed carrier surfaces, each pivotally mounted on the warhead through a carrier arm about a shaft located in a plane which is normal to the line of symmetry of the warhead and pivotable from a collapsed position in which the carrier surfaces connect to a circumferencial surface of the sub-combat unit, and to a flip-out position opened at 90° at which the carrier surfaces form a retaining area for the fall velocity of eh sub-combat unit and impart to the sub-combat unit a rotation for scanning the target area in a helical pattern during the fall of the sub-combat unit towards the target area;

a flip-out means comprising:

damping means including compressible damping members located on the casing of the warhead and means on the carrier arms for acting against and compressing said damping members to provide gentle braking of the movement of said carrier surfaces to a final flip-out position; and stopping means for restraining said carrier surfaces in said final flip-out position.

6. In a sub-combat unit according to claim 5 said damping means of said flip-out means comprising rubber bushings defining said damping members and said means on said carrier arms include a circular surface adapted for compressing said rubber bushings.

7. In a sub-combat unit according to claim 6 said stopping means including a spring lead cooperating with a recess on said circular surface of said carrier arm.

* * * * *